US005142829A

United States Patent [19]

Germain

[11] Patent Number: 5,142,829

[45] Date of Patent: Sep. 1, 1992

[54] ABRASIVE ARTICLE

[75] Inventor: Conrad M. Germain, White Bear Lake Township, Ramsey County, Minn.

[73] Assignee: Minnesota Minning and Manufacturing Company, St. Paul, Minn.

[21] Appl. No.: 828,410

[22] Filed: Jan. 31, 1992

[51] Int. Cl.[5] ..... B24D 13/06

[52] U.S. Cl. ..... 51/405; 51/407; 51/378

[58] Field of Search ..... 51/394, 398, 405, 378, 51/406, 358, 407, 401

[56] References Cited

U.S. PATENT DOCUMENTS

| | | | |
|---|---|---|---|
| 622,432 | 4/1899 | Almon . | |
| 1,697,442 | 1/1929 | Webber | 51/405 |
| 2,696,700 | 12/1954 | Tocci | 51/197 |
| 2,958,593 | 11/1960 | Hoover et al. | 51/295 |
| 3,267,623 | 8/1966 | Block | 51/406 |
| 3,562,968 | 2/1971 | Johnson et al. | 51/389 |
| 3,849,949 | 11/1974 | Steinhauser et al. | 51/406 |
| 3,912,142 | 10/1975 | Steinhauser et al. | 225/52 |
| 4,294,357 | 10/1981 | Stevens et al. | 51/406 |
| 4,518,452 | 5/1985 | Hundebol | 156/211 |
| 4,893,438 | 1/1990 | Fry et al. | 51/394 |

OTHER PUBLICATIONS

Product literature for Dynabrade Incorporated of Clarence, New York (undated).

"Coated Abrasives—Modern Tool of Industry", Coated Abrasives Manufacturers' Institute, pp. 24–25, 76–79, (1958).

*Primary Examiner*—Bruce M. Kisliuk
*Assistant Examiner*—Bryan S. Reichenbach
*Attorney, Agent, or Firm*—Gary L. Griswold; Walter N. Kirn; Peter L. Olson

[57] ABSTRACT

The present invention relates to an abrasive article comprising an aligned row of connected abrasive sheet members each having a main portion, an aperture formed in the main portion, and a plurality of arm portions perimetrically spaced about the main portion at a constant angle with respect to each adjacent arm portion. The sheet members are formed to enable the aligned row to be Z-folded such that the apertures of each respective sheet member are substantially in register, and the arm portions of each abrasive sheet member are angularly offset with respect to the arm portions of each immediately adjacent abrasive sheet portion by one-half of the angle between each of the arm portions.

9 Claims, 5 Drawing Sheets

ABRASIVE ARTICLE

TECHNICAL FIELD

This invention relates to an abrasive article and a method for making the abrasive article. Specifically, the invention involves a plurality of abrasive sheet members that are connected in a row, which row may be Z-folded to produce an abrasive article.

BACKGROUND OF THE INVENTION

Rotary and orbital tools are commonly used in conjunction with an abrasive member to abrade material from a workpiece. Most such tools include a motor, an output shaft for transmitting the rotary motion of the motor, and an abrasive member that is attached to the output shaft. One common abrasive member includes a single, circular abrasive disk that is mounted on a backing pad, typically using pressure sensitive adhesive, hook and loop fasteners, cooperating male and female threaded members, or the like. After the backing pad and abrasive member are connected to an output shaft, the rotating abrasive disk may be urged against a workpiece to abrade material from the workpiece.

Although single, circular abrasive disks are popular for some applications, they tend to lack flexibility near the edge of the disk, which limits their efficacy under circumstances requiring a more flexible abrasive. For example, contoured surfaces may be sanded more effectively with an abrasive member having a flexible edge than with one having a more rigid edge, so that the workpiece is not marred or overcut due to edge cutting by a standard circular disk. Edge cutting refers to excessive abrasion of material from a workpiece due to a stiff abrasive edge.

An improvement over the single, circular abrasive disk is an abrasive sheet member having a main portion and two or more arm portions radially projecting from the main portion. The individual abrasive sheet members are typically of substantially identical geometric configuration (e.g. a main portion and six arm portions, as in FIG. 1; a main portion and two arm portions, as in FIG. 3). As shown in FIG. 1, each individual abrasive sheet member 10 includes opposed major surfaces, one of which includes an abrasive coating 12, a body portion 14 and a plurality of arm portions 16 separated from each other by a constant angle $\alpha$ with respect to center point 17. The individual arm portions add flexibility to the periphery of individual sheet member 110. Further flexibility may be obtained by forming a plurality of cuts in each of the arm portions to form a plurality of finger portions 20. Because the finger portions 20 are collectively more flexible than the respective arm portion would have been without the cuts therein, the abrasive sheet members are particularly adapted to abrade contoured profiles with a minimum of edge cutting. The cuts in arm portions 16 are generally parallel to each other in each of the arm portions, as shown in FIGS. 1 and 3.

The individual sheet members may be either a coated abrasive or a nonwoven abrasive. The former includes a backing (e.g. cloth, paper, vulcanized fiber, or polymeric film) with abrasive grains bonded thereto by one or more binder coats of phenolic resin, urea-formaldehyde resin, acrylate resin, epoxy resin, aminoplast resin, hyde glue, urethane resin, polyester resin, or a combination thereof. Nonwoven abrasives include a substrate, which may be a porous, fibrous, nonwoven construction and an abrasive comprising individual abrasive particles on one side of the substrate. An example of such a nonwoven abrasive is U.S. Pat. No. 2,958,593 (Hoover et al.), the contents of which are hereby incorporated by reference. The abrasive particles may be made of materials such as fused aluminum oxide, ceramic aluminum oxide, heated treated aluminum oxide, silicon carbide, alumina zirconia, diamond, ceria, cubic boron nitride, garnet, and combinations thereof.

Abrasive sheet members are typically produced individually in a batch die cut operation, which tends to be a relatively slow method of production. In order to produce an abrasive article of suitable size and durability, a plurality of the abrasive sheet members must typically be assembled. Each individual abrasive sheet member has a hole 22 in the center of the main portion, and several like individual abrasive sheet members may be collected and their respective center holes axially aligned. After alignment, which is usually performed manually, each individual abrasive sheet member is manually rotated, or fanned out such that the arm portions of each individual abrasive sheet member are angularly offset by angle $\beta$, which equals $\frac{1}{2}$ of angle $\alpha$, with respect to the arm portions of each immediately adjacent sheet member, as shown in FIG. 2.

After the individual sheet members have been collected, aligned, and arranged, they may then be secured together to form an abrasive article. One type of releasable fastener that is often used to secure the collection of individual sheet members includes an arbor and retainer, as shown with reference to the present invention in FIG. 7. The arbor 190 usually includes a shaft 192 and a retainer 198 that cooperates with backing member 194 through the aligned holes to retain the collection of individual sheet members. Shaft 192 is adapted to be held by a source of rotary power, and shaft 192 transmits rotary power to the retained collection of individual abrasive members for abrasive application to a workpiece.

Alternatively, a permanent fastener (e.g. a grommet) may be used to hold the individual sheet members together to form an abrasive article. The abrasive article is then retained by an arbor and retainer in much the same manner as the collection of individual abrasive sheet members described above. Examples of such abrasive articles comprising individual abrasive sheet members are available under model numbers 93245 and 93251 from Dynabrade Incorporated of Clarence, N.Y.

The described method of producing the abrasive article is both time consuming and costly. The individual abrasive sheet members must be collected, often by hand, and their respective holes aligned. This process, in addition to being a time consuming one, carries with it the possibility that the holes may be misaligned, which can render the abrasive article difficult to connect to an arbor. Once the holes are aligned, each individual sheet member must be angularly positioned with respect to each adjacent sheet member to produce the desired abrasive article. Because the abrasive articles formed from individual abrasive sheet members may include dozens or even hundreds of individual sheets, this process is also costly and tedious. If the individual sheet members are collected and positioned at the production site, the higher cost is passed on to the consumer. However, if the individual sheet members must be assembled on the job site, the operator must halt the abrading task while collecting, aligning, fanning, and securing the individual sheet members. In view of the time and expense required to form an abrasive article according to the prior art, it is desirable to provide an abrasive article that is easily assembled and used, as well as a method for forming the abrasive article.

SUMMARY OF THE INVENTION

According to the present invention, there is provided an article for abrading a workpiece, comprising a plurality of like abrasive sheet members. Each abrasive sheet member includes (i) first and second opposed major surfaces, at least one of the major surfaces having an abrasive layer, (ii) a main portion having an aperture formed therein and a center point, and (iii) a plurality of arm portions radially projecting from said main portion, each respective arm portion perimetrically spaced from each adjacent arm portion by a constant angle with respect to the center point. Also provided are means for joining each adjacent pair of abrasive sheet members together in an aligned row, the joining means connecting an arm portion of a first abrasive sheet member to an adjacent pair of arm portions of a second abrasive sheet member. The joining means enable the aligned row of sheet members to be Z-folded with the respective apertures substantially in register and with the arm portions of each respective sheet member angularly offset about the center point one-half of the constant angle with respect to the arm portions of each immediately adjacent sheet member to form the article.

The preferred embodiment of the abrasive article includes an abrasive sheet member having six arm portions radially projecting from the main portion, each respective arm portion spaced from each adjacent arm portion at a 60° angle with respect to the center point. A pair of foldable junctions enable an aligned row of sheet members to be Z-folded with the respective apertures substantially in register and with the arm portions of each respective sheet member angularly offset about the center point 30° with respect to the arm portions of each immediately adjacent sheet member to form the article.

In another embodiment, the present invention provides for a tool for rotary abrasion of a workpiece, comprising an abrasive article as described above, and further including an arbor adapted for engagement with a motive means, the arbor including means for retaining the Z-folded row relative to the arbor, the retaining means including a member adapted for insertion through the apertures.

A method is provided for making an abrasive article, comprising the steps of: (a) providing a continuous sheet of material having first and second major surfaces, one of the surfaces having an abrasive thereon; (b) cutting from the sheet an aligned row of connected abrasive sheet members, the abrasive sheet members each having a main portion, a center point, and a plurality of arm portions radially projecting from the main portion, each respective arm portion perimetrically spaced from each adjacent arm portion by a constant angle with respect to the center point, the abrasive sheet members connected at two junctions joining one of the arm portions of each respective sheet member to two adjacent arm portions of each immediately adjacent sheet member; (c) forming an aperture in each abrasive sheet member, the apertures of each adjacent pair of abrasive sheet members equidistant from the junctions joining the pair; and (d) Z-folding the aligned row such that the apertures are substantially in register and the arm portions of each respective sheet member are angularly offset one-half of the constant angle with respect to the arm portions of each immediately adjacent sheet member.

BRIEF DESCRIPTION OF THE DRAWINGS

The invention will be more readily understood with reference to the accompanying drawings, wherein like reference numerals refer to like components throughout the several views, and wherein.

DETAILED DESCRIPTION

The present invention provides a connected, aligned row of abrasive sheet members that may be folded to form an abrasive article. Each of the connected abrasive sheet members includes a main portion and a plurality of perimetrically spaced arm portions radially projecting from the perimeter of the main portion. The connected row is designed to enable the arm portions of each abrasive sheet member to self-align with respect to the arm portions of each immediately adjacent sheet member upon Z-folding. Furthermore, each abrasive sheet member includes an aperture in the main portion thereof, and the connected row is further designed to self-align the respective apertures of each abrasive sheet member upon Z-folding. These features represent two of the advantages of the present invention, and will be better understood with reference to the appended figures.

Figure 5:
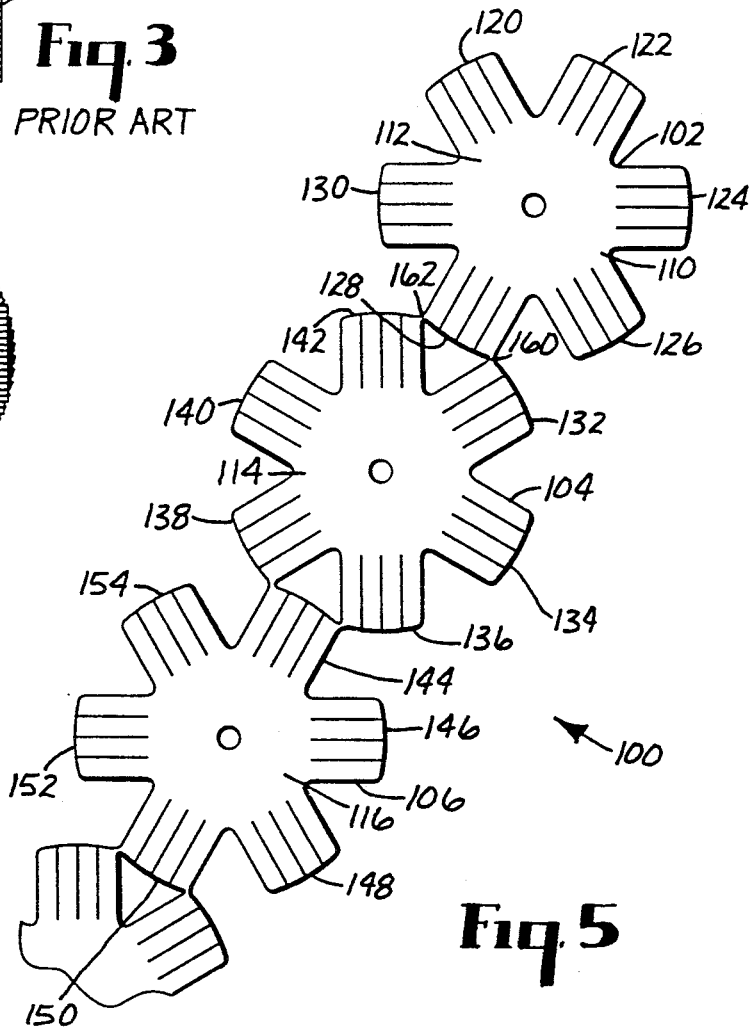
FIG. 5 is a plan view of a plurality of connected abrasive sheet members according to the present invention.

Referring now to FIG. 5, there is shown a row of connected abrasive sheet members generally designated by reference numeral 100. The illustrated embodiment includes a plurality of abrasive sheet members 102, 104, and 106, each of which includes a substrate having a first major surface 110 and a second opposed major surface (not shown). At least one major surface has an abrasive layer thereon, and in an alternate embodiment, both major surfaces have an abrasive layer thereon.

As with the individual abrasive sheets of the prior art, abrasive sheet members of the present invention may be either a coated abrasive or a nonwoven abrasive. The former includes a backing (e.g. cloth, paper, vulcanized fiber, or polymeric film) with abrasive particles bonded thereto by one or more binder coats of phenolic resin, urea-formaldehyde resin, acrylate resin, epoxy resin, aminoplast resin, hyde glue, urethane resin, polyester resin, or a combination thereof. Nonwoven abrasives include a substrate, which may be a porous, fibrous, nonwoven construction and an abrasive comprising individual abrasive particles on one side of the substrate. The particles may be made of materials such as fused aluminum oxide, ceramic aluminum oxide, heated treated aluminum oxide, silicon carbide, alumina zirconia; diamond, ceria, cubic boron nitride, garnet, or any other abrading means known in the art. For example, an abrasive sheet member sold by Minnesota Mining and Manufacturing Company of St. Paul, Minn. under model number 331D includes a cloth substrate and aluminum oxide particles bonded to the substrate using a resin binder may be used in constructing the present invention.

Figure 1:
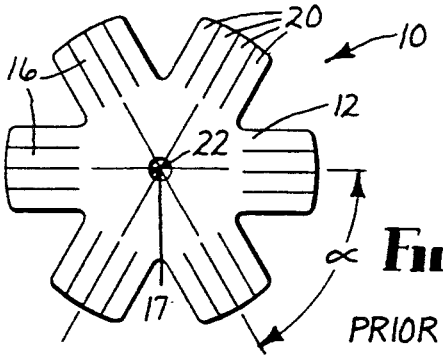
Fig. 1 PRIOR ART
FIG. 1 is a plan view of a single abrasive sheet member of the prior art.

Abrasive sheet members 102, 104, and 106 each have a body portion 112, 114, and 116, respectively, and a plurality of radially extending arm portions 120–154. The arm portions are spaced about the perimeter of the body portion at an constant angle $\alpha$, as shown in FIG. 1, meaning that the angle between each of the adjacent pairs of arm portions is substantially constant for that abrasive sheet member. In the illustrated embodiment, for example, the six arm portions 132–142 are spaced 60° apart. The desired spacing between arm portions may be determined by dividing 360° by the number of arm portions that each abrasive sheet member has.

Although the arm portions may be irregularly spaced about the perimeter of the body portion, such a configuration may be undesirable because the finished abrading article may tend to be unbalanced and to abrade material unevenly. Variations in the angular configuration of the arm portions are within the scope of the invention, although the present invention is primarily directed to abrasive sheet members having regularly perimetrically spaced arm portions.

Figure 6:
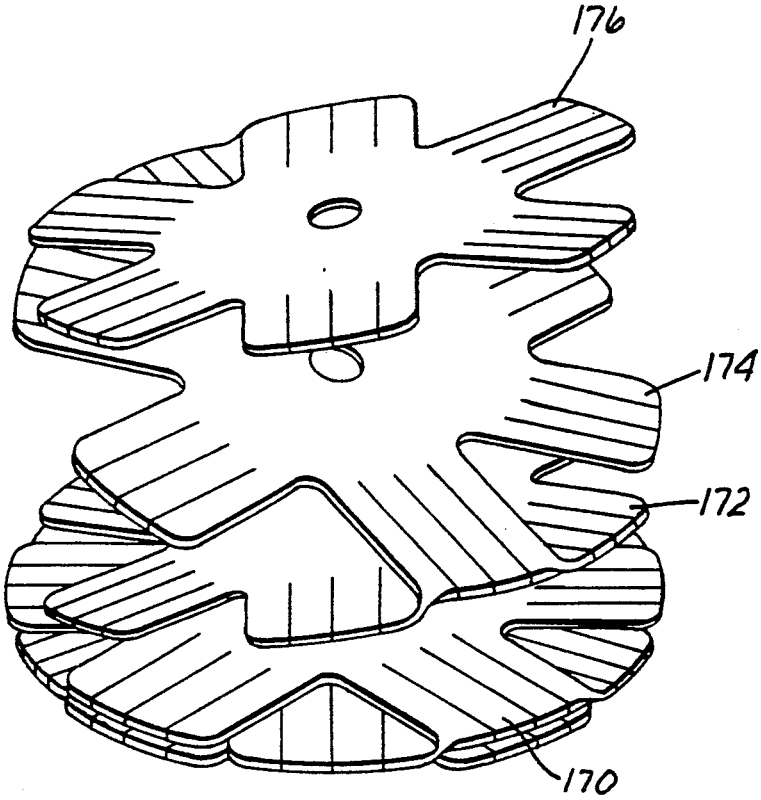
FIG. 6 is a perspective view of the connected abrasive sheet members of the present invention being Z-folded to form an abrasive article.

The present invention also provides means for joining each adjacent pair of abrasive sheet members together in an aligned row, such that the sheet members may be Z-folded to provide the abrading article. As that term is used herein, "Z-folding" refers to repeated folding of a connected row of abrasive sheet members at foldable junctions between each adjacent pair of abrasive sheet members, as shown in FIG. 6. A connected row that has been Z-folded therefore includes a plurality of connected abrasive sheet members 170, 172, 174, and 176 in stacked relationship, which may be fastened to an arbor and used to abrade a workpiece. Z-folding saves time and expense when compared to manual collection, alignment, and orientation of individual sheet members, because it enables the abrasive sheet members of the present invention to be self-aligned and oriented.

In the preferred embodiment, the joining means (hereinafter "foldable junctions") are a pair of foldable junctions between an arm portion of one abrasive sheet member and two arm portions of an adjacent abrasive sheet member. As best shown in FIG. 5, arm portion 128 of abrasive sheet member 102 is connected to arm portion 132 of abrasive sheet member 104 at foldable junction 160, and to arm portion 142 of abrasive sheet member 104 at foldable junction 162. In the preferred embodiment, as illustrated in FIG. 5, the foldable junctions are cut from a sheet material at the same time as the remainder of the abrasive sheet members, and the abrasive sheet members therefore remain in a connected row throughout production. The joining means could also include a pair of foldable junctions that are bonded (e.g. by pressure sensitive adhesive, thermal bonding) to each pair of abrasive sheet members after each sheet member is individually formed.

For each respective pair of abrasive sheet members, the single arm portion of the first sheet member is centered between the two arm portions of the second sheet member. In the preferred embodiment, the foldable junctions are positioned at the outermost corners of the arm portions of the first sheet member, and one outermost corner of each of the two adjacent arm portions of the second sheet member, as shown in FIGS. 5, 8, 10, and 12. This orientation is central to an advantage of the present invention described above. When the aligned row of connected abrasive sheet members is Z-folded at the foldable junctions between each pair of adjacent abrasive sheet members, the arm portions of each sheet member are angularly offset by angle $\beta$, which is equal to $\frac{1}{2}$ of angle $\alpha$, measured with respect to center point 17, between the arm portions of the immediately adjacent abrasive sheet members, as illustrated with respect to the prior art in FIG. 2. Each arm portion thus overlies the space between the arm portions of the abrasive sheet member below it and the abrasive sheet member above it, providing an abrasive article having the desired distribution of arm portions throughout.

This arrangement of the arm portions is desirable because the abrasive sheet members self-align as described above when the connected row is Z-folded, due to the relationship between each adjacent pair of abrasive sheet members. Thus it is not required that a person sequentially manually position each individual sheet member with respect to the adjacent sheet members, as was required of the individual sheet members of the prior art. In addition, the self-alignment of the arm portions provides flexible abrading surfaces throughout the thickness of the abrasive article because there is less overlap between adjacent abrasive sheet members than would occur if the arm portions were otherwise aligned.

Although several possible embodiments of the foldable junctions exist, several design considerations are common to each embodiment. The first involves the size of the foldable junctions between each adjacent pair of abrasive sheet members. In order to permit a user to tear off a predetermined number of abrasive sheet members, the foldable junctions are preferably easily manually torn, particularly in response to the application of shear forces. However, in the preferred embodiment of making the abrasive article of the present invention, the abrasive sheet members and the foldable junctions are cut from a sheet material, and the connected row is wound onto a take-up roller. Therefore, the foldable junctions must also be strong enough to withstand the tensile force applied during the winding portion of the production process, and unwinding during dispensation. Although the design of the foldable junctions may vary depending on the application and the materials that are used, it has been shown that foldable junctions that tear under a tensile load of approximately 10 lbs. have utility for some applications.

A further design consideration relates to the degree of protrusion of the foldable junctions after the connected row of abrasive members has been Z-folded. The foldable junctions should not project substantially from the arm portions, because any substantial projection will tend to abrade a workpiece unevenly when the Z-folded abrasive article is rotatively urged thereagainst. Thus the foldable junctions should be designed so as to minimize any projection by the junctions after the article has been Z-folded.

Figure 11:
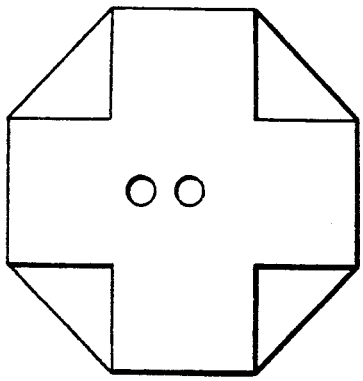
FIG. 11 is a plan view of the row of connected abrasive sheet members shown in FIG. 10 after the row has been Z-folded.
Figure 12:
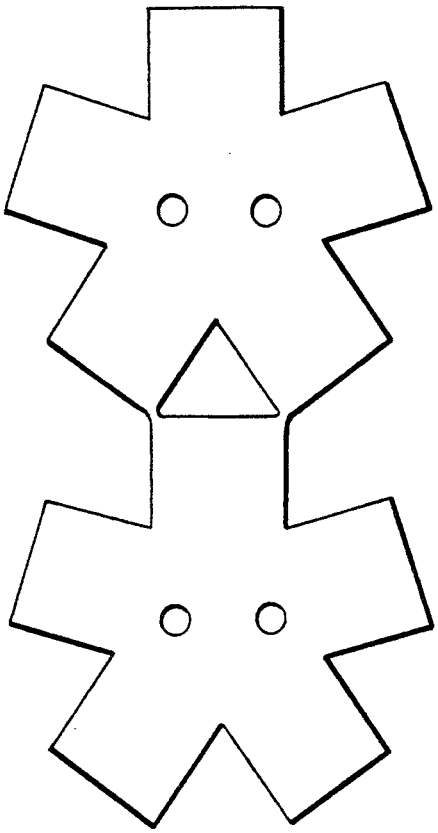
FIG. 12 is a plan view of a third embodiment of a row of connected abrasive sheet members of the present invention.
Figure 13:
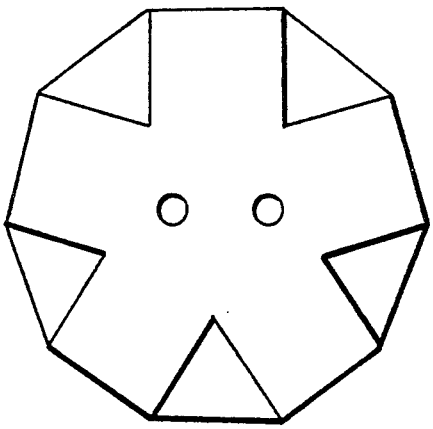
FIG. 13 is a plan view of the row of connected abrasive sheet members shown in FIG. 12 after the row has been Z-folded.

Although the embodiment shown in FIG. 5 is that of abrasive sheet members each having six arm portions, the present invention is not so limited, and has been shown to have utility with abrasive sheet members having other geometric configurations. For example, the present invention is shown with reference to abrasive sheet members having 3 arm portions (shown in a connected row in FIG. 8 and Z-folded in FIG. 9), 4 arm portions (shown in a connected row in FIG. 10 and Z-folded in FIG. 11), and 5 arm portions (shown in a connected row in FIG. 12 and Z-folded in FIG. 13). An appropriately designed abrasive sheet member having 2 arm portions or more than 6 arm portions is also contemplated, and therefore it is preferred that the abrasive sheet members have between 2 and 30 arm portions each, and most preferred that the abrasive sheet members have between 3 and 10 arm portions. However, the present invention expressly encompasses geometric configurations including more arm portions than the embodiments specifically described herein. The overall diameter of the abrasive sheet members may, for example, range from 1 cm. to 100 cm., and is usually between 5 cm. and 20 cm.

Figure 2:
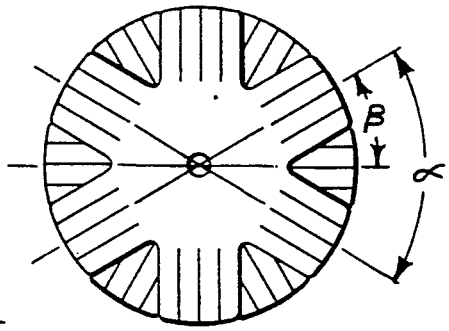
Fig. 2 PRIOR ART
FIG. 2 is a plan view of a plurality of individual, stacked abrasive sheet members of the prior art.
Figure 3:
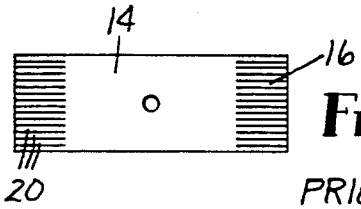
Fig. 3 PRIOR ART
FIG. 3 is a plan view of a single rectangular abrasive sheet member of the prior art.
Figure 4:
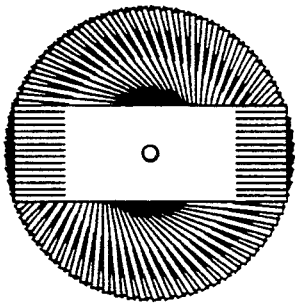
Fig. 4 PRIOR ART
FIG. 4 is a plan view of a plurality of individual, stacked rectangular abrasive sheet members of the prior art.

The present invention also includes within its scope a connected row of abrasive sheet members wherein adjacent sheet members have different numbers of arm portions. For example, alternating abrasive sheet members having 4 arm portions with abrasive sheet members having 8 arm portions is also possible using the features of the present invention. It should be noted that abrasive sheet members having larger numbers of arm portions tend to require that the arm portions be thinner, and therefore less durable under the stresses applied during abrasion. Durability is important because greater durability allows an operator to work for longer periods of time, and thus abrasive sheet members having the number of arm portions listed above, because the arm portions tend to be wider, are desired. Furthermore, abrasive sheet members having very few arm portions, such as the three armed abrasive sheet members shown in FIGS. 8 and 9, tend to have more pronounced corners when the row is Z-folded, as indicated by reference numeral 180 in FIG. 9. These corner portions may abrade a workpiece unevenly, which mitigates in favor of abrasive sheet members having greater numbers of arm portions. The optimum number of arm portions for a given application must be determined based on the material to be abraded, the profile of the workpiece, and other considerations. Alternately, the ends of each arm portion may be rounded slightly about a constant radius, as shown in FIGS. 1 and 2 with respect to the prior art, which may help to eliminate the potential overcutting due to the pronounced corners described above.

Figure 8:
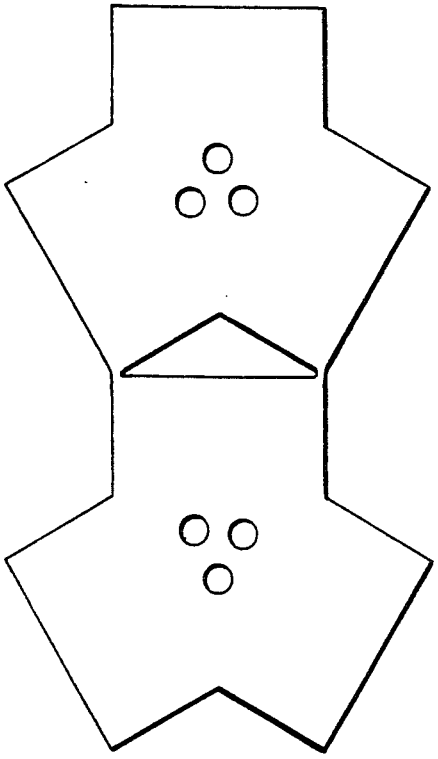
FIG. 8 is a plan view of one embodiment of a row of connected abrasive sheet members of the present invention.
Figure 10:
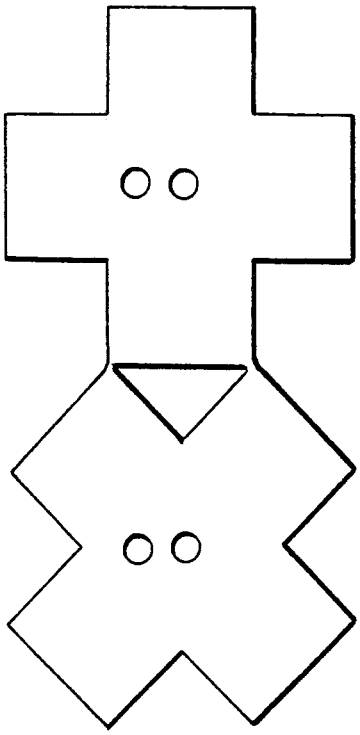
FIG. 10 is a plan view of a second embodiment of a row of connected abrasive sheet members of the present invention.
Figure 9:
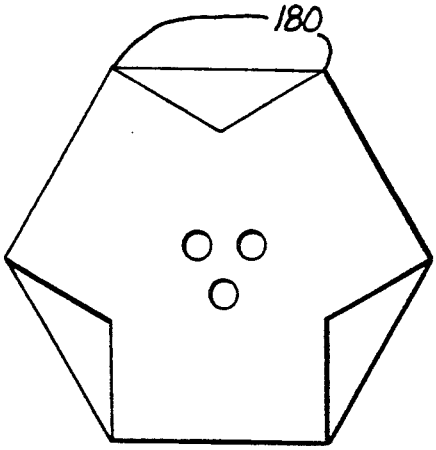
FIG. 9 is a plan view of the row of connected abrasive sheet members shown in FIG. 8 after the row has been Z-folded.

Formed in the body portions of each of the abrasive sheet members is at least one aperture, which apertures are substantially in register when the connected row of abrasive sheet members is Z-folded. The preferred embodiment, as shown in FIG. 5, includes one aperture formed at the center point of each abrasive sheet member. Also contemplated are multiple apertures formed in the body portions of each of the abrasive sheet members, as shown in FIGS. 8 and 9 (3 apertures regularly spaced at a constant distance from the center), FIGS. 10 and 11 (2 apertures; one in the center, and one spaced from the center), and FIGS. 12 and 13 (2 apertures; each spaced from the center), so long as each aperture of each abrasive sheet member is substantially in register with the corresponding apertures of the other sheet members when the sheet members are Z-folded. Furthermore, the aperture or apertures may be hexagonal, triangular, or otherwise shaped to fit a shaft or pin inserted therethrough to retain the abrasive article.

The importance of the apertures being substantially in register lies in part in the method used to retain a group of Z-folded abrasive sheet members. An abrasive article according to the present invention may include very few sheet members (e.g. 2) or very many (e.g. 1000), but most preferably contains between 10 and 50 abrasive sheet members. After a predetermined number of abrasive sheet members have been separated from a supply of connected abrasive sheet members and Z-folded to form the abrasive article, an arbor and a retainer cooperatively engage through the apertures to retain the abrasive article with respect to the arbor. The arbor may then be attached to a source of rotary power to rotate the article, which may be urged against a workpiece to abrade the workpiece. Because the apertures of the abrasive sheet members are self-aligned when the row is Z-folded, the step of manually aligning the apertures of numerous individual sheet members, as taught by the prior art, is reduced or eliminated.

Figure 7:
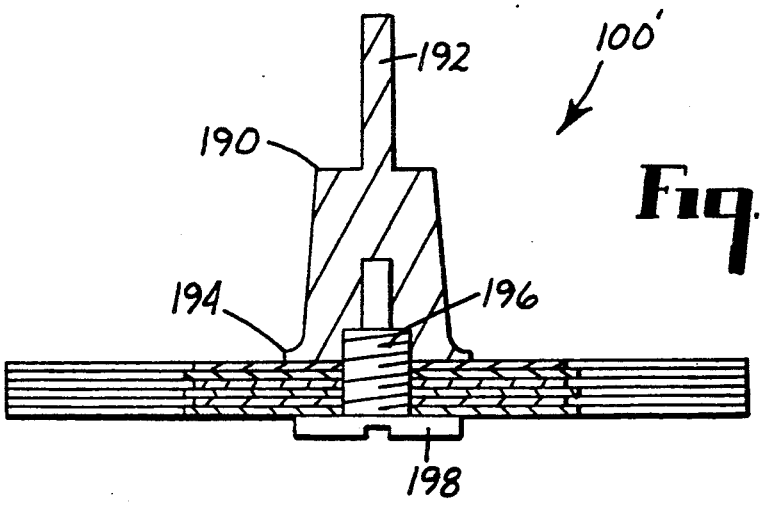
FIG. 7 is a side sectional view of the abrasive article of the present invention including a cooperating arbor and retainer.

In the preferred embodiment, as shown in FIG. 7, the arbor 190 includes a shaft portion 192 and a backing member 194, including a threaded chamber 196 adapted for receipt of a cooperative threaded male retainer 198. Retainer 198 and arbor cooperate through the aligned apertures of the retained abrasive article 100' to retain the article with respect to shaft portion 192. Shaft portion 192 is adapted to be held by a source of rotary power, and transmits the rotary power to abrasive article 100', which may then be urged against a workpiece to abrade the workpiece. An exemplary arbor and retainer for use with the abrasive article of the present invention is sold by the 3M Company of St. Paul, Minn. under the trademark Roloc Plus TM. Alternate embodiments of arbor 190 and retainer 198 include an arbor with a portion that passes through the aligned apertures, a single piece arbor/retainer wherein arbor/retainer is passed through the aligned apertures until the abrasive article is retained within an annular groove near the base of the arbor/retainer, and the like.

The present invention may also be used in conjunction with a backing pad, in order to provide extra support to the abrasive article. If a backing pad is used, the backing pad is preferably smaller than the diameter of the abrasive article, and is preferably constructed of rubber, metal, plastic, or reinforced plastics. If rubber is used, it should have a hardness between 20 and 95 Shore A durometer, preferably between 70 and 75 Shore A durometer.

In order to reduce the possibility of edge cutting and to permit the abrasive article to be used to abrade contoured surfaces, the preferred embodiment of the present invention includes arm portions that are slashed. The preferred embodiment is shown in FIG. 5, wherein each arm portion of each abrasive sheet member includes a plurality of spaced parallel cuts through the material comprising the arm portions, thereby adding flexibility to the outer edges of the arm portions. The slashed edges could also include cuts in a radial direction, non-linear cuts or other similar variations.

Also provided is a method of making an abrasive article according to the present invention. Generally, the method involves providing a continuous sheet of material having an abrasive on one surface to a cutting apparatus. The apparatus cuts an aligned row of connected abrasive members from the sheet of material, and collects the row of connected abrasive sheet members for shipment or packaging. The row of connected abrasive sheet members may also be divided into smaller units (e.g. 500 sheet members) and packaged for convenient dispensation and use.

Figure 14:
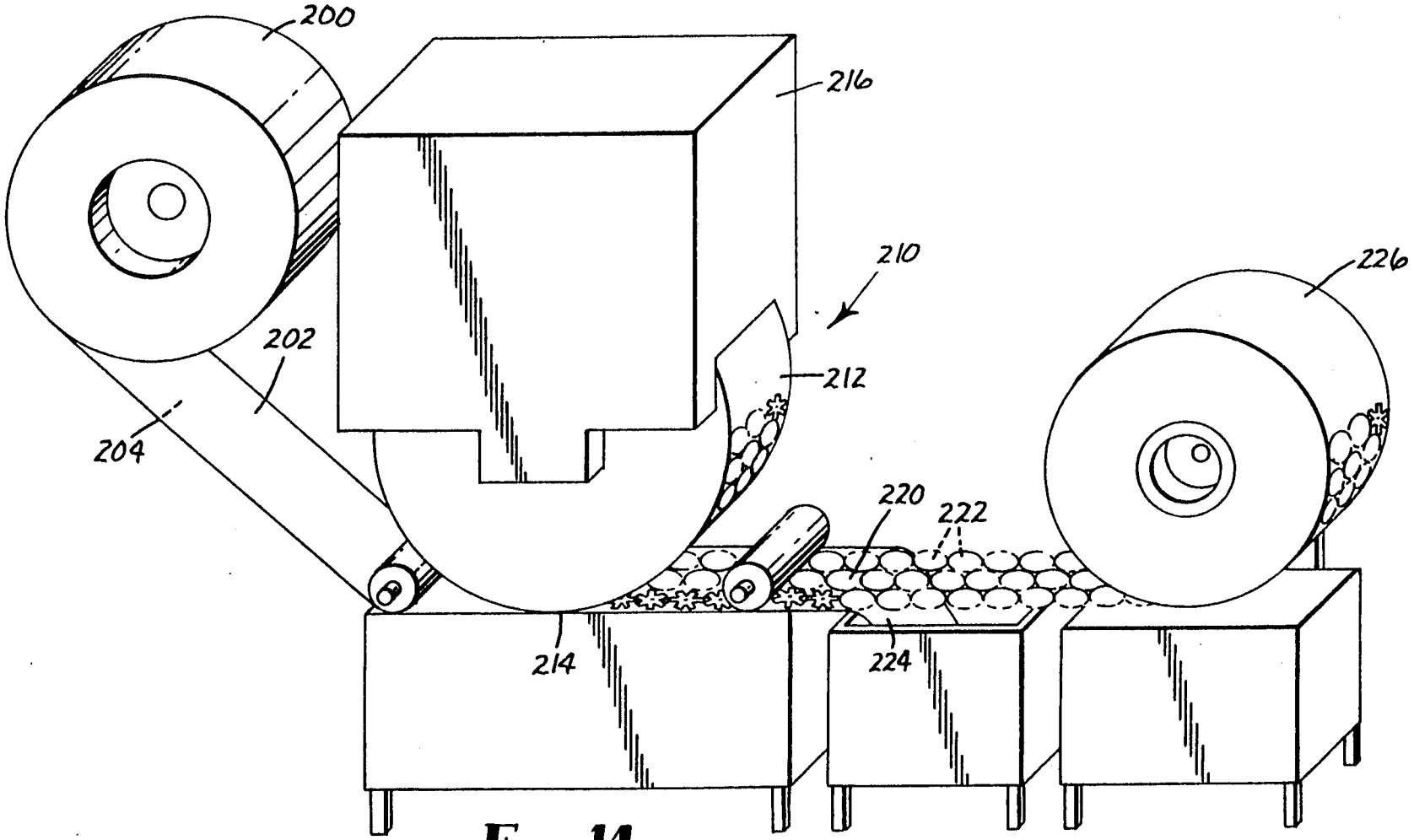
FIG. 14 is a perspective view of an apparatus for making the connected abrasive sheet members according to the method of the present invention.

As shown in FIG. 14, a continuous supply of sheet material 200 is provided having first and second major surfaces 202 and 204, respectively, at least one of which comprises an abrasive layer. The sheet material and abrasive layer (or layers, if each major surface is coated with an abrasive) are the same as those described above with reference to the abrasive sheet members. Sheet material 200 is supplied to a cutting apparatus 210, which includes die cutter 212, support frame 214, and power source 216. Sheet material 200 may be sized to permit a single, continuous row of connected abrasive sheet members, or may be sized to permit the production of multiple rows of connected abrasive sheet members, as indicated at 220. The dimensions of die cutter 212 may be designed t o match the width of the sheet material.

Die cutter 212 is shown as a continuous rotary die cutter, meaning that the die will cut the connected abrasive sheet members from the sheet material continuously, as opposed to cutting the connected abrasive sheet members in a batch cutting operation. Although the connected, aligned row of abrasive sheet members could be die cut in long rows (e.g. 40 sheet members per batch), continuous rotary die cutting is the preferred embodiment for manufacturing purposes. In the preferred embodiment the die cuts the abrasive sheet members and the foldable junctions simultaneously, as well as the aperture or apertures in the body portions of each of the abrasive sheet members. The die may also be adapted to form cuts in the arm portions to produce the desired slashed edges.

After the connected abrasive sheet members 222 are cut from the sheet material 200, weed 224 is separated from the sheet members and discarded. The connected abrasive sheet members are then rotatively collected on roller 226 for shipping and/or dispensation. As noted previously, the required design strength of the foldable junctions depends in part on the force with which roller 226 withdraws the connected abrasive sheet members from cutting apparatus 210.

As described briefly above, large rolls of connected abrasive sheet members could easily be divided into several smaller rolls, to aid in packaging, dispensation, and use. The connected abrasive sheet members of the present invention may be dispensed for use from a container having a continuous roll of connected abrasive sheet members therein. The connected sheet members may be manually torn from the roll, or alternately, means for severing a predetermined number of the sheet members from the roll could be provided. An apparatus that may be useful in this regard is disclosed in U.S. Pat. No. 3,849,949 (Steinhauser et al.), the disclosure of which is hereby incorporated by reference. Alternatively, a roll of the connected sheet members could be rotatively mounted, and a predetermined number of sheet members torn off for Z-folding and use.

The present invention has now been described with reference to several embodiments thereof. It will be apparent to those skilled in the art that many changes can be made in the embodiments described without departing from the scope of the invention. Thus, the scope of the present invention should not be limited to the structures described herein, but only by structures described by the language of the claims and the equivalents of those structures.

I claim:

1. An article for abrading a workpiece, the article comprising:

(a) a plurality of abrasive sheet members, having substantially identical geometric configuration each including:

(i) first and second opposed major surfaces, at least one of said major surfaces having an abrasive layer, (ii) a main portion having an aperture formed therein and a center point, and (iii) a plurality of arm portions radially projecting from said main portion, each respective arm portion perimetrically spaced from each adjacent arm portion by a constant angle with respect to said center point; and (b) means for joining each adjacent pair of abrasive sheet members together in an aligned row, said joining means connecting an arm portion of a first abrasive sheet member to an adjacent pair of arm portions of a second abrasive sheet member;

said joining means enabling said aligned row of sheet members to be Z-folded with said respective apertures substantially in register and with said arm portions of each respective sheet member angularly offset about said center point one-half of said constant angle with respect to said arm portions of each immediately adjacent sheet member to form the article.

2. The article of claim 1 wherein said abrasive sheet members each include between 2 and 30 arm portions.

3. The article of claim 1 wherein said abrasive sheet members each include six arm portions.

4. The article of claim 1 wherein said abrasive sheet members and said joining means are formed from a continuous sheet material.

5. An article for abrading a workpiece, the article comprising:

(a) a plurality of like abrasive sheet members, having substantially identical geometric configuration each including:

(i) first and second opposed major surfaces, said first major surface having an abrasive layer, (ii) a main portion having an aperture formed in the center thereof and a center point, (iii) six arm portions radially projecting from said main portion, each respective arm portion spaced from each adjacent arm portion by a 60° angle with respect to said center point; and (b) first and second foldable junctions for connecting each adjacent pair of abrasive sheet members together to form an aligned row, said first foldable junction connecting a first arm of a first abrasive sheet member of said pair to first and second adjacent arms of a second abrasive sheet member of said pair, said second foldable junction connecting said first arm of said first abrasive sheet member of said pair to a second arm of said second abrasive sheet member of said pair;

said foldable junctions enabling said aligned row of sheet members to be Z-folded with said respective apertures substantially in register and with said arm portions of each respective sheet member angularly offset about said center point 30° with respect to said arm portions of each immediately adjacent sheet member to form the article.

6. A tool for rotary abrasion of a workpiece, the tool comprising:

(a) a plurality of like abrasive sheet members, having substantially identical geometric configuration each including:

(i) first and second opposed major surfaces, at least one of said major surfaces having an abrasive layer, (ii) a main portion having an aperture formed therein and a center point, and (iii) a plurality of arm portions radially projecting from said main portion, each respective arm portion perimetrically spaced from each adjacent arm portion by a constant angle with respect to said center point; and (b) means for joining each adjacent pair of abrasive sheet members together in an aligned row, said joining means connecting an arm portion of a first abrasive sheet member to arm portions of a second abrasive sheet member;

said joining means enabling said aligned row of sheet members to Z-fold with said respective apertures substantially in register and with said arm portions of each respective sheet member angularly offset about said center point one-half of said angle with respect to said arm portions of each immediately adjacent sheet member; and (c) an arbor adapted for engagement with a motive means, said arbor including means for retaining said Z-folded row relative to said arbor, said retaining means including a member adapted for insertion through said apertures.

7. The article of claim 6 wherein said abrasive sheet members each include between 2 and 30 arm portions.

8. The article of claim 6 wherein said abrasive sheet members each include six arm portions.

9. The article of claim 6 wherein said joining means and said abrasive sheet members are formed from a continuous sheet material.

* * * * *

UNITED STATES PATENT AND TRADEMARK OFFICE

CERTIFICATE OF CORRECTION

PATENT NO. : 5,142,829

DATED : September 1, 1992

INVENTOR(S) : Conrad M. Germain

It is certified that error appears in the above-indentified patent and that said Letters Patent is hereby corrected as shown below:

Col. 1, line 49, "110" should read --10--.

Col. 9, line 39, "t o" should read --to--.

Col. 10, line 60, "like" should be deleted.

Signed and Sealed this

Twenty-seventh Day of September, 1994

*Attest:*

*Attesting Officer*

Bruce Lehman

BRUCE LEHMAN

*Commissioner of Patents and Trademarks*